United States Patent [19]

Ivnas et al.

[11] 4,227,966

[45] Oct. 14, 1980

[54] METHOD FOR COMBUSTING A MIXTURE OF SPENT MAGNESIUM SULPHITE DIGESTION LIQUOR AND ALKALINE OXYGEN BLEACH LIQUOR

[75] Inventors: Lennart Ivnas, Sundsvall; Karl-Erik Lekander, Alingsås, both of Sweden

[73] Assignee: Sunds Aktiebolag, Sweden

[21] Appl. No.: 17,967

[22] Filed: Mar. 6, 1979

[30] Foreign Application Priority Data

Mar. 10, 1978 [SE] Sweden ..... 7802789

[51] Int. Cl.[2] ..... D21C 11/02; D21C 11/04; D21C 11/12

[52] U.S. Cl. ..... 162/36; 162/65; 162/84

[58] Field of Search ..... 162/65, 36, 33, 34, 162/30 R, 84, 86, 30 K

[56] References Cited

U.S. PATENT DOCUMENTS

| | | | |
|---|---|---|---|
| 2,385,955 | 10/1945 | Tomlinson | 162/36 |
| 2,716,589 | 8/1955 | Byrns | 162/36 |
| 3,296,064 | 1/1967 | Cann | 164/30 R |
| 3,843,473 | 10/1974 | Samuelson et al. | 162/65 |

FOREIGN PATENT DOCUMENTS

| | | | |
|---|---|---|---|
| 7438432 | 11/1973 | France | 162/65 |

*Primary Examiner*—S. Leon Bashore
*Assistant Examiner*—Steve Alvo
*Attorney, Agent, or Firm*—Lerner, David, Littenberg & Samuel

[57] ABSTRACT

A method for oxygen delignifying magnesium sulfite pulp is disclosed. More particularly, a method is disclosed by which the spent liquors from digestion of magnesium sulfite pulp and from alkaline oxygen bleaching of the pulp can be combined and combusted without a smelt of sodium compounds being formed during the combustion.

8 Claims, 1 Drawing Figure

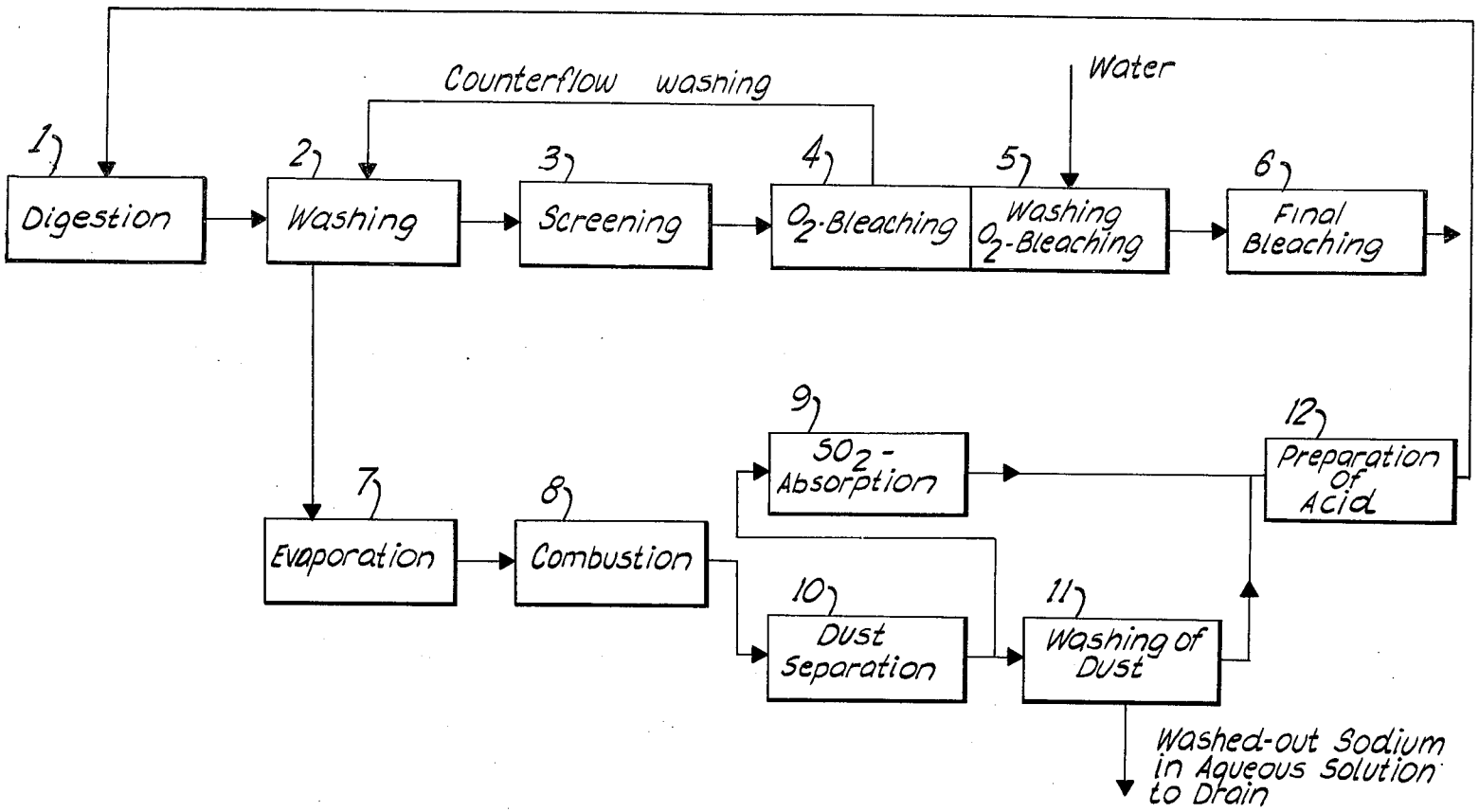
1
Digestion
2
Washing
3
Screening
4
$O_2$-Bleaching
5
Washing $O_2$-Bleaching
6
Final Bleaching
Water
Counterflow washing
7
Evaporation
8
Combustion
9
$SO_2$-Absorption
10
Dust Separation
11
Washing of Dust
12
Preparation of Acid
Washed-out Sodium in Aqueous Solution to Drain

METHOD FOR COMBUSTING A MIXTURE OF SPENT MAGNESIUM SULPHITE DIGESTION LIQUOR AND ALKALINE OXYGEN BLEACH LIQUOR

BACKGROUND OF THE INVENTION

During the last twenty years, sulfite pulp has increasingly been prepared by using soluble bases. Of the bases, magnesium base have led to the simplest and cheapest recovery systems. Therefore, processes using magnesium base, i.e., the magnesium sulfite processes, now dominate this portion of the industry.

The shift to magnesium base has in most cases solved the immediate environmental problems. The requirements on environmental protection, however, have become more stringent, and further measures are expected to be necessary in the future for reducing the effluent loads of substances from sulfite mills detrimental to the environment.

One of the greatest sources of effluent loads from a magnesium sulfite process is from the bleaching portion of the plant. One way of avoiding some of these effluent loads would be to use an oxygen bleaching stage. It is known that such an oxygen bleaching stage can produce sulfite pulp with low kappa numbers and can substantially reduce the effluent loads from the bleaching portion of the plant, e.g., BOD, COD and colour effluent load can be reduced.

Such an oxygen bleaching stage was, however, thought to have certain insurmountable problems in practice. Oxygen bleaching must take place in an alkaline atmosphere. Normally, sodium hydroxide is added in the oxygen bleaching for obtaining the alkaline conditions. Thus, the spent liquor from the oxygen bleaching will contain sodium. It is the presence of this sodium in the oxygen bleaching spent liquor which was believed to render oxygen bleaching impossible in practice.

In the normal process of producing magnesium sulfite pulp, the spent liquor from the digestion is combusted and the magnesium therein is recovered in the form of a magnesium oxide dust. This dust is then used in preparing new acid cooking liquor (for the digestion stage of the process).

In order to obtain the environmental advantages of oxygen bleaching, the spent liquor from the oxygen bleaching step also has to be recovered, evaporated and combusted. Since it would be much too expensive to evaporate and combust the oxygen spent liquor and the digestion spent liquor separately, the evaporation and combustion has to be carried out together to make the process economically feasible.

When spent liquors from pulping processes on sodium base are combusted, a smelt of sodium carbonate and sodium sulfide is obtained. Thus, it was believed that, upon combustion of spent liquor containing both magnesium and sodium compounds, the smelt formed by the sodium compounds would precipitate on the heat transfer surfaces in the boiler of the recovery system giving rise to insurmountable problems in the recovery of the magnesium oxide dust. In view of these problems, it was thought that oxygen bleaching of magnesium sulfite pulp was economically infeasible.

It is possible theoretically to use magnesium oxide as the alkaline source in the oxygen bleaching stage to try to avoid the problem. However, magnesium oxide is not suitable in view of some problems involved with it. For example, the delignification of the pulp to a desirable low kappa number cannot be carried out without unfavourably effecting the pulp quality. Satisfactory oxygen bleaching, therefore, in practice requires the use of sodium hydroxide as the alkaline source.

SUMMARY OF THE INVENTION

It has now been discovered that sodium hydroxide can be used in the oxygen bleaching and delignifying stage of the manufacture of magnesium sulfite pulp without serious problems in the combustion of the mixed digestion and oxygen bleaching spent liquors. Thus, by the process of the present invention, the environmental advantages of oxygen bleaching and delignifying can be obtained in an economically feasible manner. These results are obtained by a process comprising:

(1) preparing pulp by digestion in a magnesium-containing cooking acid liquor;

(2) washing the digested pulp with a washing liquid so as to remove a major part of spent cooking acid liquor from the digested pulp, said spent cooking acid liquor containing magnesium;

(3) oxygen bleaching said digested pulp in the presence of oxygen and a maximum of 40 kilograms of sodium hydroxide per ton of dry unbleached pulp, thereby receiving a sodium-containing spent liquor;

(4) passing said sodium-containing spent liquor in counterflow for use as said washing liquid, thereby receiving a mixed liquor of said magnesium-containing and said sodium-containing spent liquor; and (5) combusting said mixed liquor to produce a magnesium oxide-containing dust which can be utilized in the preparation of the magnesium-containing cooking acid liquor.

By limiting the amount of sodium hydroxide added in the oxygen bleaching stage, no smelt of sodium carbonate and sodium sulfide is obtained in the combustion step.

In a preferred embodiment of the invention the ratio of the magnesium and the sodium amount in the mixed liquor, measured as molar ratio of magnesium oxide to sodium hydroxide is not below 1.

In another preferred embodiment of the invention the combustion of said mixed liquor is performed at a temperature of at least 1000° C., preferably at least 1200° C.

In yet another preferred embodiment of the invention, the process of pulp treatment takes place continuously. This is accomplished by using the dust obtained from the combustion step of the process of the invention to prepare a cooking acid liquor for the digestion stage of the process. In order to prevent a buildup of sodium in the cooking acid, however, at least 90% of the sodium should preferably be removed from the dust. This removal can be accomplished, for example, by washing with water.

During the removal of sodium compounds from the dust, a certain amount of magnesium compounds are also lost. However, since the amount of sodium compounds to be removed from the dust is regulated by the amount of sodium hydroxide added in the oxygen bleaching and delignifying stage, the amount of magnesium lost can be tolerated.

In yet another preferred embodiment of the present invention, the combined sodium-containing spent liquor and magnesium-containing spent liquor is evaporated prior to combustion. This evaporation can, of course, be achieved by the same means used to combust the combined digestion and oxygen bleaching spent liquids.

In carrying out the process of the present invention, the digestion is preferably performed until a kappa number of from about 15 to about 35 is achieved. In the oxygen bleaching stage, preferably from about 5 to about 40 kilograms of sodium hydroxide per ton of dry unbleached pulp is added and the bleaching stage is carried out until a kappa number of from about 6 to about 20, preferably to about 16 is obtained. Also, in washing the digested pulp, it is preferable to remove at least 97% by weight of the spent cooking acid liquor from the digested pulp.

BRIEF DESCRIPTION OF THE DRAWINGS

The present invention is described in greater detail in the following detailed description which refers to the FIGURE showing a schematic representation of a process for oxygen bleaching and delignifying pulp in accordance with the present invention.

DETAILED DESCRIPTION

Referring to the FIGURE, a process for the continuous preparation of magnesium sulfite pulp is illustrated. The wood pulp is digested in step 1. The digested pulp is then washed in step 2. After the washing step 2, but prior to the addition of alkaline in the oxygen bleaching and delignifying steps 4 and 5, at least 97% of the spent digestion liquor is washed out of the pulp to prevent the sodium hydroxide addition in the oxygen bleaching and delignifying step from being too high. After washing, the pulp is screened in step 3 in a closed screening plant. Subsequently, alkaline is added and the pulp is oxygen bleached and delignified in step 4. The bleached pulp is then washed in step 5 as part of the oxygen bleaching step. The washed, bleached pulp is passed to final bleaching, while the spent liquor from the oxygen bleaching plant is passed in counterflow for use in the washing step 2 as the washing liquid for washing the spent digestion liquor from the digested pulp. The mixed liquor from the washing step 2 containing the spent digestion liquor and the spent oxygen delignifying liquor is evaporated in step 7 and combusted in step 8. Sulfur dioxide is absorbed from the combustion vapors (step 9) and the dust containing magnesium and sodium compounds is separated and collected (step 10). The recovered dust is washed in step 11 to remove at least 90% of the sodium compounds. The washed magnesium oxide dust is then used in the preparation of new digestion cooking acid in step 12. Any of the well-known conventional apparatus can be used in performing the individual steps of this method.

The following example is intended to illustrate, but not to limit the invention.

EXAMPLE

A process in accordance with the present invention was performed and the effluent loads therefrom were tested to determine the BOD, COD and amount of colour. These effluent loads were compared with the effluent loads from a conventional bleaching plant using a chlorine/chlorine dioxide, caustic extraction, chlorine dioxide, caustic extraction, chlorine dioxide (C/D E D E D) bleaching system. The results of this comparison are listed below in Table 1.

TABLE 1

| | Effluent loads | | |
|---|---|---|---|
| | BOD kg/ton of pulp | COD kg/ton of pulp | Dye kg/ton of pulp |
| Conventional bleaching plant - C/D E D E D | 14.5 | 108.0 | 105.0 |
| Oxygen bleaching with recovery and combustion of oxygen liquor in accordance with present invention | 6.0 | 45.0 | 35.0 |

The above results demonstrate the technical and environmental advantages obtained by the method of the present invention.

It will be understood that the embodiments described above are merely examplary and the person skilled in the art may make many variations and modifications without departing from the spirit and scope of the invention. All such modifications and variations are intended to be included within the scope of the invention as defined in the appended claims.

What is claimed is:

1. A method for combining and recovering spent magnesium sulfite digestion liquor and alkaline oxygen bleaching liquor, without forming a smelt of sodium compounds during combustion of the combined spent liquors, comprising:

(a) digesting pulp in a magnesium sulfite-containing cooking acid liquor;

(b) washing the digested pulp with a washing liquid so as to remove at least 97% of spent cooking acid liquor from the digested pulp, said spent cooking acid liquor containing magnesium;

(c) oxygen bleaching said digested pulp in the presence of oxygen and from about 5 to about 40 kilograms of sodium hydroxide per ton of dry unbleached pulp, thereby obtaining a sodium-containing spent liquor;

(d) using said sodium-containing spent liquor as said washing liquid, thereby obtaining a mixed liquor of said magnesium-containing spent liquor and said sodium-containing liquor wherein said mixed liquor has a ratio of magnesium to sodium compounds measured as a molar ratio of magnesium oxide to sodium hydroxide of at least 1;

(e) combusting said mixed liquor to produce a mangesium oxide-containing dust;

(f) removing a sufficient amount of the sodium compounds from said magnesium oxide containing dust to prevent a build-up of sodium in said cooking acid liquor such that a smelt of sodium compounds is not formed during said combusting step; and (g) using said dust in the preparation of the magnesium sulfite-containing cooking acid liquor.

2. A process according to claim 1, wherein said oxygen bleaching is performed until a kappa number of from about 6 to about 16 is achieved.

3. A process according to claim 1, wherein the combustion of said mixed liquor is performed at a temperature of at least 1000° C.

4. A process according to claim 1, wherein the combustion of said mixed liquor is performed at a temperature of at least 1200° C.

5. A process according to claim 1, which further comprises removing at least 90% by weight of sodium compounds from said magnesium oxide-containing dust in the preparation of said magnesium-containing cooking acid liquor.

6. A process according to claim 5, wherein said process is performed continuously.

7. A process according to claim 1, wherein said digestion is performed until a kappa number of from about 15 to about 35 is achieved.

8. A process according to claim 1, wherein said oxygen bleaching is performed until a kappa number of from about 6 to about 20 is achieved.

* * * * *